United States Patent [19]

Kanbar

[11] Patent Number: 4,962,781

[45] Date of Patent: Oct. 16, 1990

[54] COLLAPSIBLE ROLLING CANE

[76] Inventor: Maurice S. Kanbar, 4 E. 77th St., New York, N.Y. 10021

[21] Appl. No.: 456,517

[22] Filed: Dec. 26, 1989

[51] Int. Cl.[5] ..... A45B 1/00

[52] U.S. Cl. ..... 135/65; 135/74; 135/85; 280/641

[58] Field of Search ..... 135/65, 66, 74, 75, 135/85, DIG. 11, 67; 272/70.3; 280/641, 87.05

[56] References Cited

U.S. PATENT DOCUMENTS

| | | | |
|---|---|---|---|
| 2,598,168 | 5/1952 | Hooz et al. | 280/641 |
| 3,168,328 | 2/1965 | Hill, Sr. | 280/641 |
| 4,029,311 | 6/1977 | Chanslor et al. | 272/70.3 |
| 4,212,493 | 7/1980 | Ledesky | 135/67 |
| 4,277,100 | 7/1981 | Beougher | 135/67 |
| 4,341,381 | 7/1982 | Norberg | 135/74 |
| 4,461,471 | 7/1984 | Brastow | 135/74 |
| 4,765,355 | 8/1988 | Kent | 135/67 |

FOREIGN PATENT DOCUMENTS

| | | | |
|---|---|---|---|
| 491349 | 5/1919 | France | 280/87.05 |
| 2255881 | 7/1975 | France | 135/77 |
| 231983 | 1/1986 | German Democratic Rep. | 135/85 |
| 8701079 | 12/1988 | Netherlands | 135/88 |
| 806873 | 10/1936 | Switzerland | 135/88 |
| 219031 | 8/1942 | Switzerland | 135/88 |
| 16282 | of 1899 | United Kingdom | 135/66 |
| 685781 | 1/1953 | United Kingdom | 135/75 |

*Primary Examiner*—David A. Scherbel
*Assistant Examiner*—Lan Mai

[57] ABSTRACT

A collapsible rolling cane adapted to assist an elderly or handicapped person in walking. The cane includes a front leg having a handle attached to its upper end at a height convenient to the user, a single front wheel being mounted on the lower end. A shorter tubular rear leg is pivotally connected at its upper end to the leaf of a first hinge joined to the front leg at a position below the upper end thereof. The lower end of the rear leg is joined to the midpoint of a transverse axle on either end of which a rear wheel is mounted. Bridging the legs is a foldable arm, one end of which is pivotally connected to the leaf of a second hinge joined to the front leg at a position above its lower end, the other end of the arm being pivotally connected through a longitudinal slot in the rear leg to a slide therein, whereby when the cane is collapsed to put it in an inactive state, the slide rides up the rear leg to fold the arm and position the front and rear legs in parallel relation, and when the cane is put in an active state, the slide rides down the rear leg to extend the arm and cause the front and rear legs to assume an acute angle and the front and rear wheels then engage the ground at the points of a triangle to render the rolling cane stable.

6 Claims, 3 Drawing Sheets

COLLAPSIBLE ROLLING CANE

BACKGROUD OF INVENTION

1. Field of Invention:

This invention relates generally to devices adapted to assist an elderly or handicapped person in walking, and in particular to a collapsible rolling cane for this purpose which is highly stable and safe to use.

2. Status of Prior Art:

Elderly or handicapped individuals who are not impaired in regard to the use of their legs may nevertheless have difficulty in walking. This may be due to a loss of balance, an inability to stand up without assistance, or other factors which make walking for these individuals a hazardous activity.

Yet walking is the most natural and beneficial form of human exercise and is essential to well being. A person who, when assisted, is physically capable of walking has much to gain by doing so. As a practical matter, however, few individuals can afford to retain a nurse or other attendant to assist them in walking. It is therefore the common practice to employ as the assistant a so-called walker.

A conventional walker is a three-sided, light-weight metal framework having a rail which is grasped by the user and cushioned legs which engage the ground. A walker must be raised by the user with each advancing step; and while the walker is not heavy, the user who is usually quite weak is quickly tired. Moreover, a walker by its very nature is conspicuously unattractive and it embarrasses many users to be seen with a walker.

The oldest form of walking assistance is the walking stick or cane. This has a long history, for the cane, probably first used as a weapon, gradually became a symbol of strength and power. Thus the rulers in ancient Egypt carried a symbolic staff. The word cane was first applied to a walking stick in the 16th Century when bamboo became the popular material for a walking stick.

But like a walker a cane must also be raised with each advancing step, and it is also inherently unstable which limits its use by elderly or handicapped people. When the tip of a cane engages the ground and its handle is grasped by the user, the cane is then free to wobble in any direction, and with an unsteady user, the cane does not offer adequate support.

To overcome the drawbacks of a conventional cane, rolling canes have become commercially available expressly intended for elderly or handicapped users. In one such rolling cane which is collapsible, the cane includes a front leg on whose tip a double wheel is mounted, the upper end of the front leg having a handle attached thereto. Pivotally connected to the front leg is a rear leg having a double-wheel mounted on its tip. The front and rear legs are bridged by a folding arm, such that when the arm is extended, the legs are angled and the front and rear double wheels engage the ground at points more than a foot apart, this being the active state of the cane. And when the arm is folded, the legs are parallel to each other, thereby collapsing the rolling cane. The great advantage of a rolling cane is that the user is not required with each step to lift the cane.

This known form of rolling cane has several practical disadvantages, the most serious being that it can be rocked from side to side and is therefore unstable. And while the front leg which is hinged to the rear leg can be turned by its handle to steer the rolling cane, when steering, the rolling cane becomes even more unstable, for there is nothing to prevent the rolling cane from at the same time swaying to either side.

Moreover, the handle of this rolling cane is released by the user, it is not self-standing, but will fall to the left or right. Though by contrast with a rolling cane, a conventional walker leaves much to be desired for the reasons previously given, a walker has the advantage of being self-standing, and if the walker is released, it will remain upright.

Another drawback of a conventional rolling cane is that it cannot be braked. Hence if the user becomes weak and wishes to keep the cane from rolling so that he can support himself, he cannot do so.

SUMMARY OF INVENTION

In view of the foregoing, the main object of this invention is to provide a collapsible rolling cane which is non-rocking, stable and self-standing.

More particularly, an object of this invention is to provide a rolling cane having three wheels which when the cane is in its active state engage the ground at the points of a triangle to render the cane stable in all respects.

Yet another object of the invention is to provide a rolling cane which can be braked from its handle.

Still another object of the invention is to provide a rolling cane having a handle whose height is adjustable.

Also an object of the invention is to provide a rolling cane that can be manufactured at relatively low cost and which operates efficiently and reliably.

Briefly stated, these objects are attained in a collapsible rolling cane adapted to assist an elderly or handicapped person in walking. The cane includes a front leg having a handle attached to its upper end at a height convenient to the user, a single front wheel being mounted on the lower end. A shorter tubular rear leg is pivotally connected at its upper end to the leaf of a first hinge joined to the front leg at a position below the upper end thereof. The lower end of the rear leg is joined to the midpoint of a transverse axle on either end of which a rear wheel is mounted. Bridging the legs is a foldable arm, one end of which is pivotally connected to the leaf of a second hinge joined to the front leg at a position above its lower end, the other end of the arm being pivotally connected through a longitudinal slot in the rear leg to a slide therein, whereby when the cane is collapsed to put it in an inactive state, the slide rides up the rear leg to fold the arm and position the front and rear legs in parallel relation, and when the cane is put in an active state, the slide rides down the rear leg to extend the arm and cause the front and rear legs to assume an acute angle and the front and rear wheels then engage the ground at the points of a triangle to render the rolling cane stable.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Figure 2:
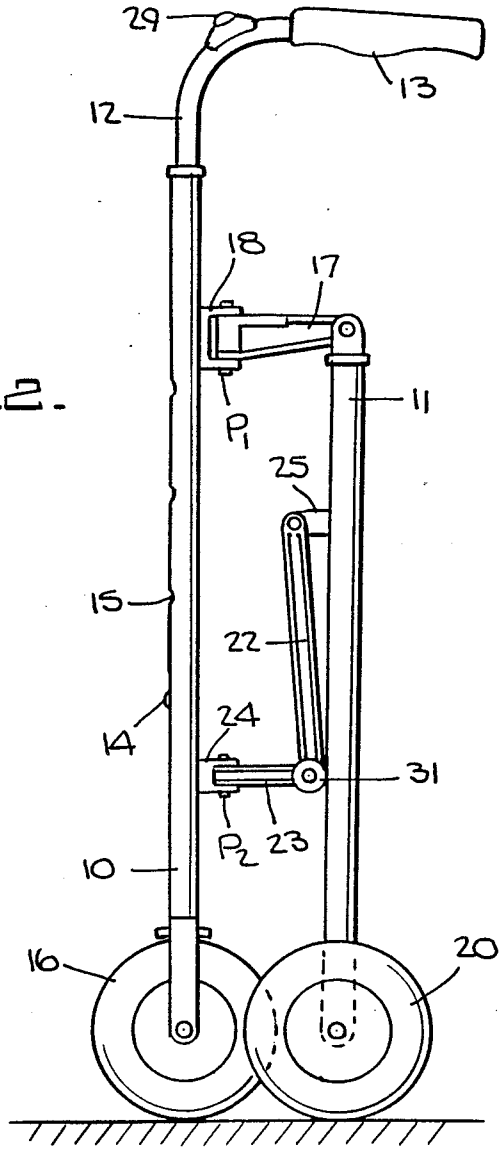
FIG. 2 is an elevational view of the cane in its collapsed state.
Figure 1:
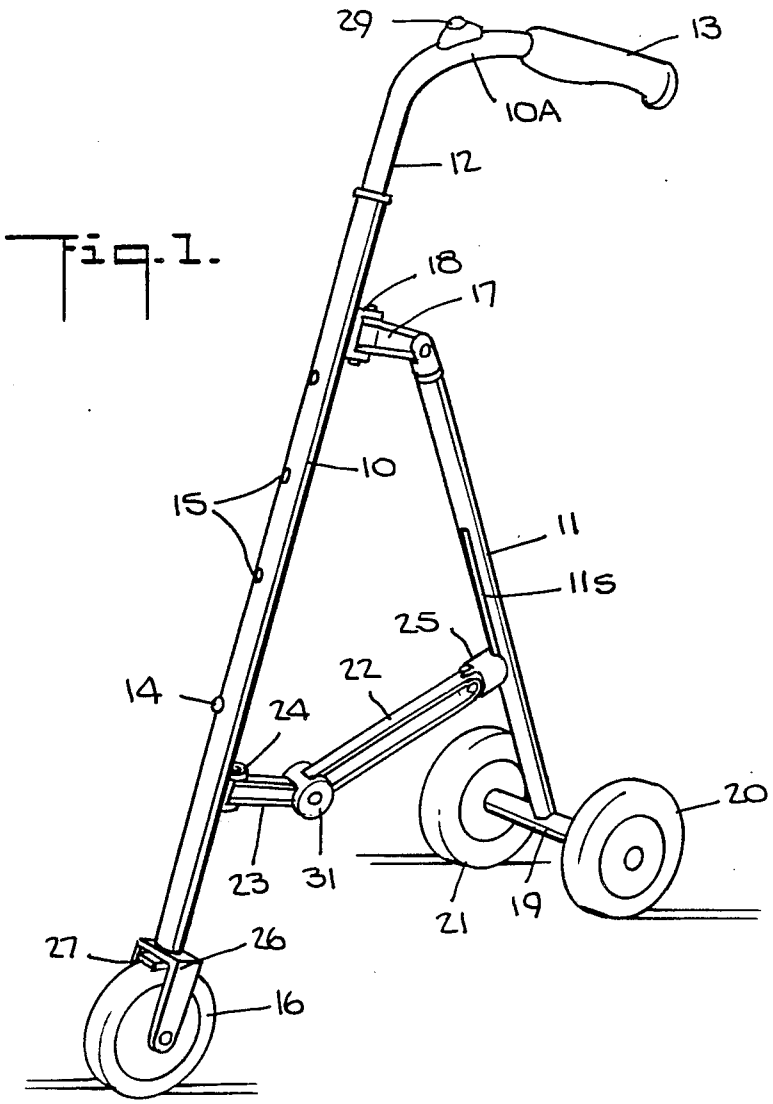
FIG. 1 is a perspective view of a collapsible rolling cane in accordance with the invention.
Figure 3:
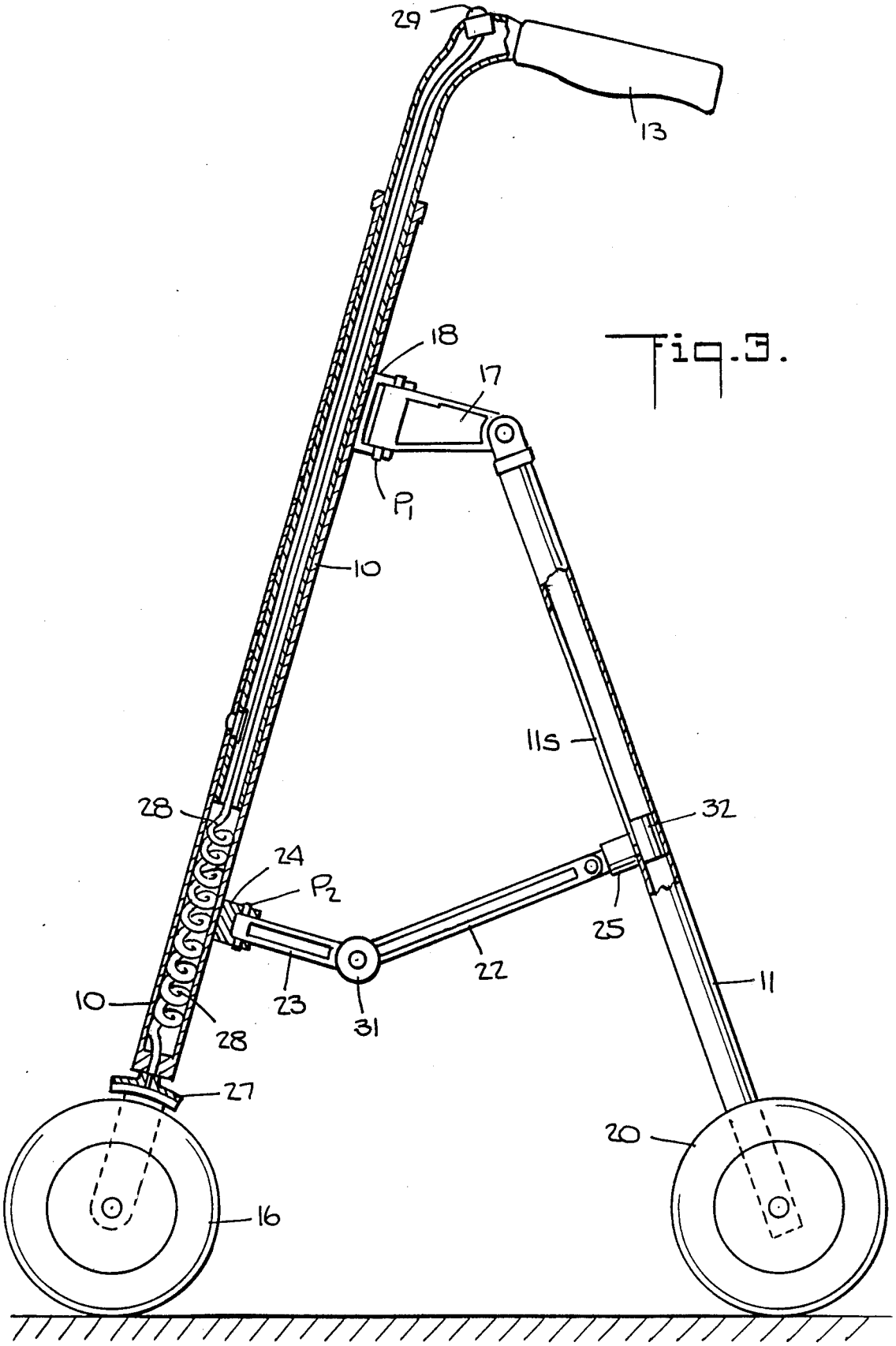
FIG. 3 is a side view, partly in section, of the cane in its active state.

Referring now to FIGS. 1 to 3, a collapsible rolling cane in accordance with the invention includes a front leg 10 made of tubular metal such as aluminum or stainless steel, and a shorter tubular metal rear leg 11 having a longitudinal slot 11S therein. Telescopically received in front leg 10 is a tubular rod 12 whose upper end is crooked to form a handle bar 10A on which is fitted a handle 13 of neoprene, or other resilient, non-slip material, making the handle comfortable to grasp.

Rod 12 is provided with a spring-biased detent 14 which is received in a hole selected from a series of holes 15 in a longitudinal row of spaced holes along front leg 10. Thus one can readily adjust and set the extent to which rod 12 is telescoped within front leg 10 and thereby adjust the elevation of handle 13 so that it is convenient for the user.

Mounted by means of a yoke 26 on the lower end of front leg 10 is a front wheel 16 provided with a rubber tire so that the wheel will grip the ground and not slip. The upper end of rear leg 11 is pivotally coupled to the leaf 17 of a first hinge 18 welded or otherwise joined to front leg 10 at a position below the upper end of this leg. The hinge includes a pivot pin $P_1$ parallel to front leg 10 so that leaf 17 is swingable laterally with respect to this leg.

The lower end of rear leg 11 is welded or otherwise joined to the midpoint of a transverse axle 19 on either end of which is mounted a rear wheel (wheels 20 and 21). Bridging the front and rear legs is a foldable arm 22 whose front end is pivotally connected by coupler 31 to the leaf 23 of a second hinge 24 joined to front leg 10 at a position thereon above the lower end of this leg. Hinge 24 includes a pivot pin $P_2$ parallel to front leg 10 so that leaf 23 is swingable laterally with respect to this leg.

The rear end of foldable arm 23 is pivotally connected to a post 25 coupled through slot 11S to a cylindrical slide 32 slidable within rear leg 11 within the limits defined by slot 11S. Thus foldable arm 22 is shiftable from a position as shown in FIG. 1 in which the arm is at the low end of slot 11S and is then extended, to a position in which it is at the high end of the slot and is folded as shown in FIG. 2.

In the collapsed state of the rolling cane in which arm 22 is folded up, as shown in FIG. 2, front and rear legs 10 and 11 are now in parallel relation so that the tire of front wheel 16 is then received in the space between rear wheels 20 and 21 to provide a compact structure that may be easily stored or transported. In practice, a stretchable rope ring may be provided to encircle the legs of the rolling cane to maintain it in its inactive state.

When arm 22 is folded out, as shown in FIGS. 1 and 3, to put the rolling cane in its active state—and this is done simply by pulling rear leg 11 away from front leg 10—then the rear leg forms an acute angle with the front leg. The angle is limited by the length of arm 22 which bridges the legs. In the active state, front wheel 16 and rear wheels 20 and 21 engage the ground at the corner points of a triangle, the front wheel being at the apex.

In the active state, the rolling cane has the stability of a tripod and is non-rockable. Because front leg 10 is hinged relative to rear leg 11, it may be turned by the handle to steer the cane as it is being rolled. But in so steering the cane, it will not rock or sway because of the spaced-apart rear wheels which resist such motion. And because the single front wheel acts as the steering wheel and turns about the point at which it engages the ground, the cane is very easy to steer.

It must be borne in mind that the user of the rolling cane is usually an individual who is in a weakened condition by reason of advanced age or some other factor. It is essential, therefore, that the operation of the rolling cane require the expenditure of a minimal amount of energy.

On occasion the user of the rolling cane may experience weakness and find it necessary to brake the cane so that it will not roll and he can steady himself. Or the user may wish to brake the rolling cane while waiting for a light to change, or for some other reason.

To this end, front wheel 16, which is attached by yoke 26 to the lower end of front leg 10, is provided below the cross arm of this yoke with an arcuate brake pad 27. This pad, whose curvature conforms to that of the wheel tire, is normally raised above the tire, as shown in FIG. 1.

Figure 5:
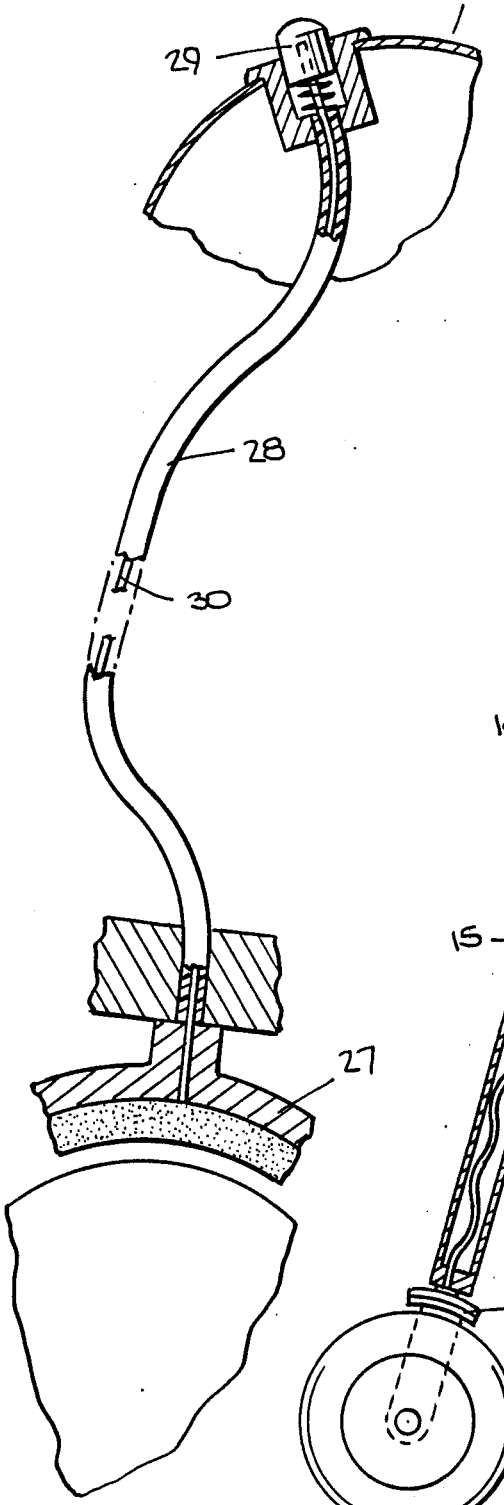
FIG. 5 illustrates the braking mechanism of the cane.
Figure 4:
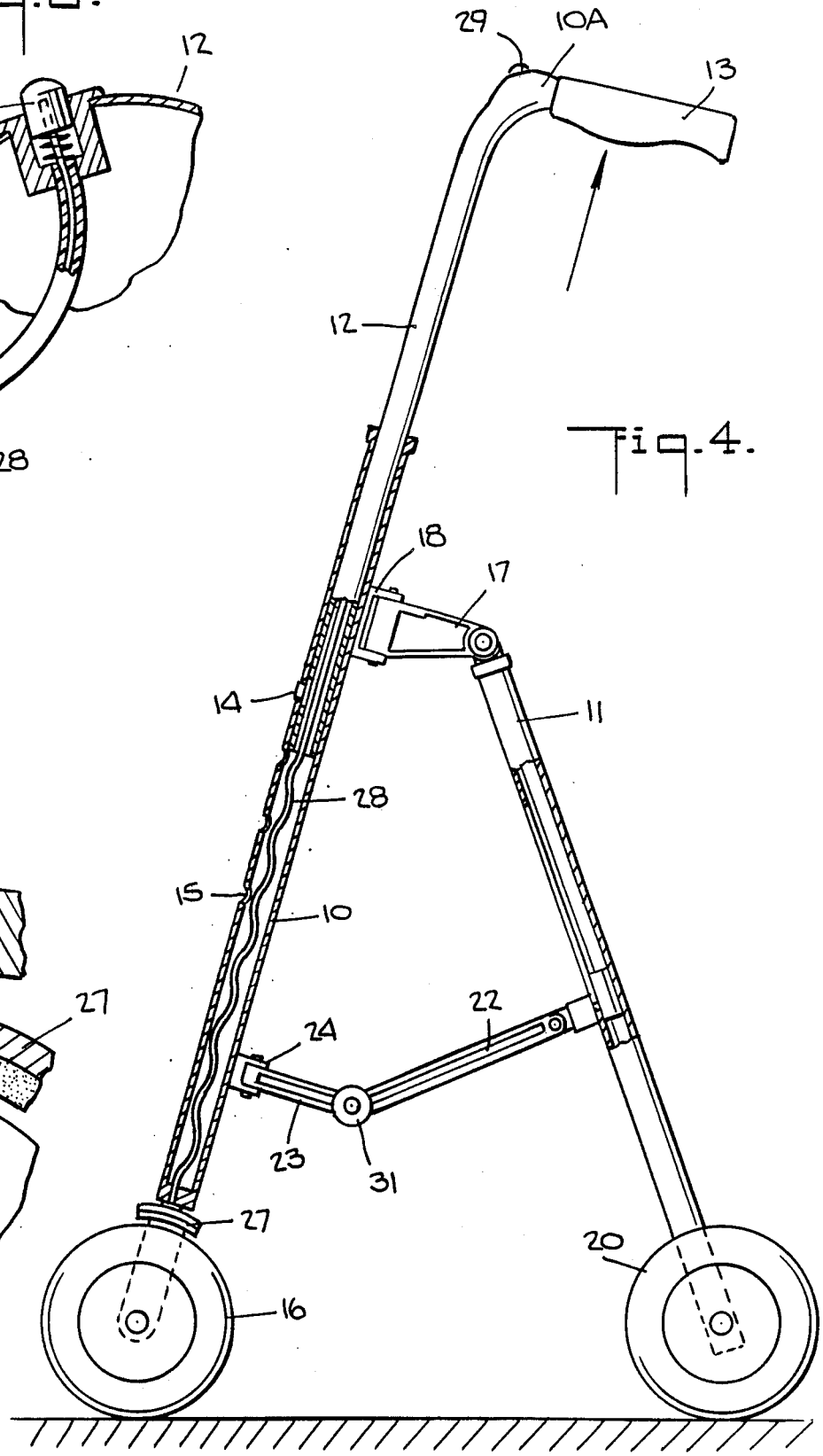
FIG. 4 shows the cane as it is being folded to collapse it.

As best seen in FIGS. 3, 4 and 5, brake pad 27 is linked by a Bowden cable 28 to a spring-biased actuator button 29 mounted on handle bar 10A and therefore directly accesible to the hand of the user grasping the handle Bowden cable 28 includes a spring steel wire 30 enclosed in a casing, such cables being normally used to transmit longitudinal motions over distances, particularly around corners.

When button 29 is pressed in by the user and kept so pressed, the brake is caused to engage the tire of the front wheel to arrest movement of the rolling cane. When the button is released, the brake pad is then retracted and the cane is again free to roll.

The Bowden cable is coiled within front leg 10 to provide a reserve length, as shown in FIG. 3, so that should handle rod 12 which telescopes within this leg be raised to elevate the handle, the cable will more or less uncoil to retain its connection with the brake pad and the actuator button, as shown in FIG. 4.

While there has been shown and described a preferred embodiment of a collapsible rolling cane in accordance with the invention, it will be appreciated that many changes and modifications may be made therein without, however, departing from the essential spirit thereof. Thus instead of a telescoping handle rod on the front leg, the handle may have a fixed position on the front leg at an elevation convenient to users whose height does not exceed six feet, in which case it is not necessary to provide a coiled Bowden cable, but only a straight cable of fixed length.

And in practice, one may mount a hook bracket on the leaf 17 of first hinge 18, so that if the user goes shopping, the handle of a shopping bag may be hooked on the bracket, the bag then being suspended in the space between the front and rear legs. Also in practice, rod 12, instead of having a single handle bar, may be formed to provide a pair of handle bars so that the user can grasp these bars with both hands.

I claim:

1. A collapsible rolling cane adapted to assist an elderly or other person who has difficulty in walking, said cane comprising:

(a) a front leg having a front wheel mounted at its lower end, a handle attached to its upper end, a first hinge joined to the front leg at a position below its upper end, said first hinge having a pivoted leaf, and a second hinge joined to the front leg at a position above its lower end, said second hinge having a pivoted leaf;

(b) a shorter tubular rear leg having a slide therein and whose upper end is pivotally coupled to the leaf of the first hinge;

(c) a transverse axle having a rear wheel mounted on either end thereof to provide a pair of spaced apart rear wheels, the lower end of the rear leg being joined to said axle at its midpoint; and (d) an arm bridging the front and rear legs, one end of the arm being pivotally coupled to the leaf of said second hinge, the other end of the arm being pivotally connected through a longitudinal slot in the tubular rear leg to said slide therein, whereby when the cane is collapsed to put it in an inactive state, the slide rides up the rear leg to fold the arm and position the front and rear legs in parallel relation and to position the front wheel intermediate the spaced apart rear wheels; and when the cane is put in an active state, the slide rides down the rear leg to extend the arm and cause the front and rear legs to assume an acute angle and the front and rear wheels then engage the ground at the points of a triangle to render the rolling cane stable.

2. A rolling cane as set forth in claim 1, further including means for braking the front wheel and provided with a brake actuator adjacent said handle.

3. A rolling cane as set forth in claim 1, wherein said front and rear legs are formed of tubular metal.

4. A rolling cane as set forth in claim 3, further including a hollow rod telescopically received in the front leg, the upper end of the rod being crooked to define a handle bar on which said handle is attached.

5. A rolling cane as set forth in claim 4, wherein said rod is provided with a detent that is received in a selected hole in a longitudinal row of holes in said front leg, whereby the elevation of the handle may be adjusted to a desired height.

6. A rolling cane as set forth in claim 5, further including a Bowden cable which goes through the telescoping front leg and hollow rod and is provided with an inner wire connected at one end to a brake pad in operative relation to said front wheel and connected at the other end to an actuator button mounted on the handle bar.

* * * * *